United States Patent [19]

Collins et al.

[11] 4,037,378

[45] * July 26, 1977

[54] WINDOW FRAME

[75] Inventors: David R. Collins, Washington Crossing, Pa.; Sheldon N. Katz, Cherry Hill, N.J.

[73] Assignee: Replacement Products Industries Corporation, Cornwells Heights, Pa.

[ * ] Notice: The portion of the term of this patent subsequent to May 24, 1994, has been disclaimed.

[21] Appl. No.: 660,760

[22] Filed: Feb. 24, 1976

[51] Int. Cl.[2] ..... E04B 1/62; E06B 3/54; E05C 3/02

[52] U.S. Cl. ..... 52/397; 52/656; 52/616; 49/449; 52/475; 52/402; 52/403

[58] Field of Search ..... 49/DIG. 1, 449; 52/204, 52/616, 397–399, 403, 616, 304, 475–477, 656, 758 H, 307, 308, 402; 403/295

[56] References Cited

U.S. PATENT DOCUMENTS

| | | | |
|---|---|---|---|
| 2,965,935 | 12/1960 | Olsen | 403/295 |
| 3,205,630 | 9/1965 | Felix et al. | 52/476 |
| 3,295,283 | 1/1967 | Griffith et al. | 52/616 |
| 3,335,524 | 8/1967 | Carson | 52/403 |
| 3,411,247 | 11/1968 | Fleming | 52/616 |
| 3,436,884 | 4/1969 | Bell et al. | 49/DIG. 1 |
| 3,462,884 | 8/1969 | La Bissoniere | 49/DIG. 1 |
| 3,866,380 | 2/1975 | Benson | 52/656 |
| 3,910,254 | 10/1975 | Morgan | 52/304 |

*Primary Examiner*—James L. Ridgill, Jr.
*Attorney, Agent, or Firm*—Seidel, Gonda & Goldhammer

[57] ABSTRACT

The window frame is adapted to receive at least one sash and has metal portions on an outdoor face thermally insulated from metal portions on an indoor face to thereby provide a thermal break. At least in part, the thermal break is attained by way of a thermal barrier strip having spaced parallel zones of contact with juxtaposed walls of the metal portions.

8 Claims, 8 Drawing Figures

FIG. 6
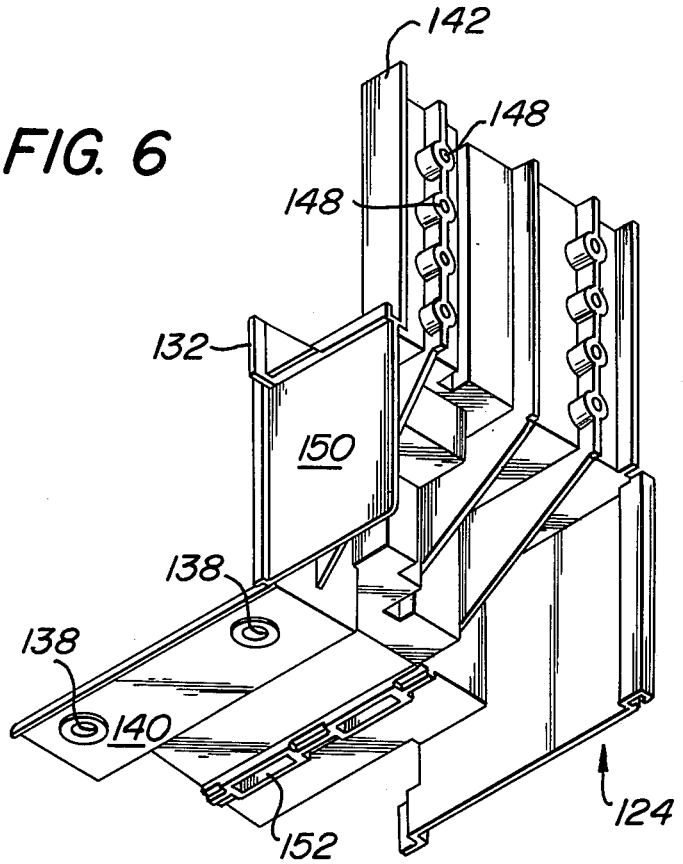
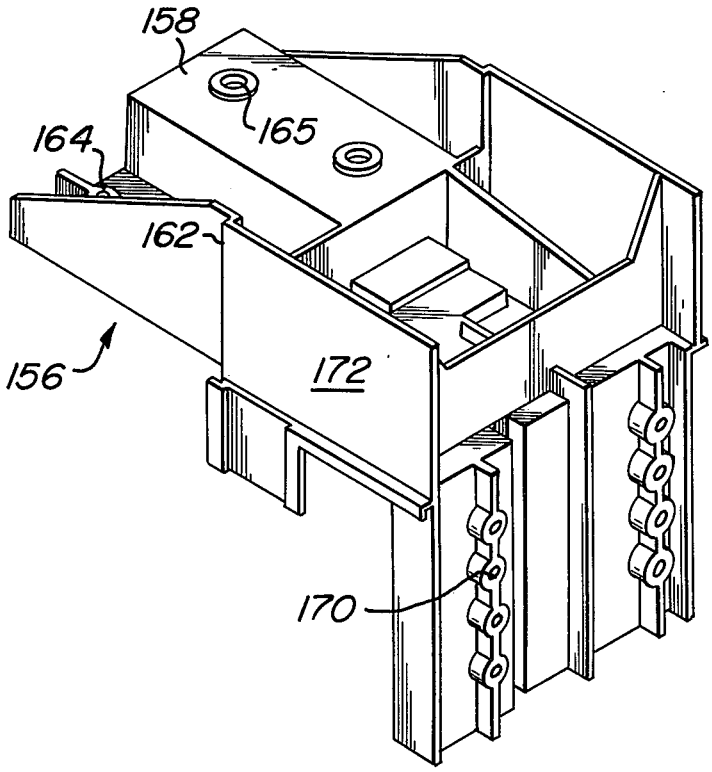
FIG. 8

WINDOW FRAME

COMPANION CASE

Companion pending patent application Ser. No. 661,199 for WINDOW filed on Feb. 25, 1976 discloses a window adapted for use with the frame of the present invention.

BACKGROUND

A large number of window frames have been proposed heretofore. A typical window frame has one or more sashes which may be movable or stationary. To our knowledge, none of the prior art window frames provide a complete thermal break between metal portions on an outdoor face and metal portions on an indoor face to minimize heat loss by conduction as per the present invention.

DISCLOSURE

This invention is directed to a window frame adapted to receive at least one window sash. The frame is rectangular and has an outdoor face and an indoor face. The frame is comprised of parallel side members connected together at one end by a top member and connected together at the other end by a sill member.

The window frame includes four corner members. Each frame member is connected to an adjacent frame member by one of the corner members. The corner member are of non-metallic material such as a polymeric plastic. Each frame member has a metal portion on an outdoor face thermally insulated from a metal portion on an indoor face by a non-metallic thermal barrier strip. Each thermal barrier strip has spaced parallel zones of contact with juxtaposed walls of the metal portions associated therewith. Non-metallic fasteners are provided at spaced points for joining each thermal barrier strip to the juxtaposed walls.

It is an object of the invention to provide a window frame having a complete thermal break between metal portions on an outdoor face and metal portions on an indoor face thereof.

It is another object of the present invention to provide a window frame which is thermally insulated in a manner for receiving preformed thermal barrier strips and other preformed components for thermally insulating an outdoor face from an indoor face while at the same time being adapted to receive at least one movable sash.

Other objects will appear hereinafter.

For the purpose of illustrating the invention, there is shown in the drawings a form which is presently preferred; it being understood, however, that this invention is not limited to the precise arrangements and instrumentalities shown.

FIG. 6 is a perspective view of the corner member shown in FIG. 5.

FIG. 8 is a perspective view of the corner member shown in FIG. 7.

Referring to the drawing in detail, wherein like numerals indicate like elements, there is shown in FIG. 1 the indoor face of a window frame in accordance with the present invention designated generally as 10.

Figure 1:
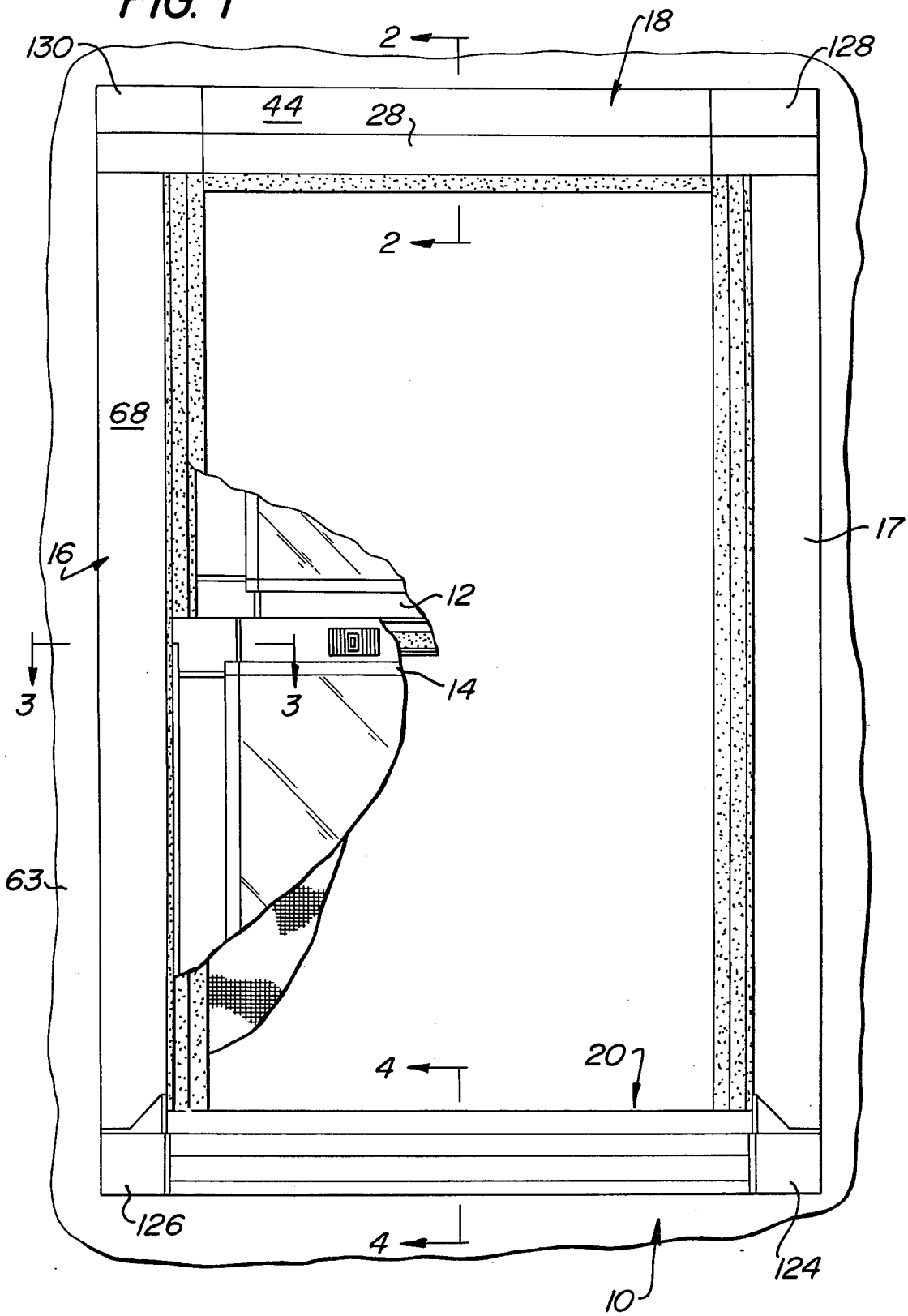
FIG. 1 is a front elevation view of the window frame in accordance with the present invention as seen from the indoor face thereof.

The window frame 10 is adapted to receive one or more sashes. For purposes of illustration, the frame 10 is provided with an upper sash 12 and a lower sash 14. The sashes 12 and 14 are prefarably of the type disclosed in the aforementioned copending patent application wherein there is a complete thermal break between metal members on the indoor and outdoor faces thereof.

The frame 10 includes spaced parallel side members 16 and 17 connected together at their upper end by a top member 18. A sill member 20 interconnects the lower ends of the side members 16, 18. The manner in which the side members, top member and sill member are interconnected will be discussed hereinafter.

Figure 2:
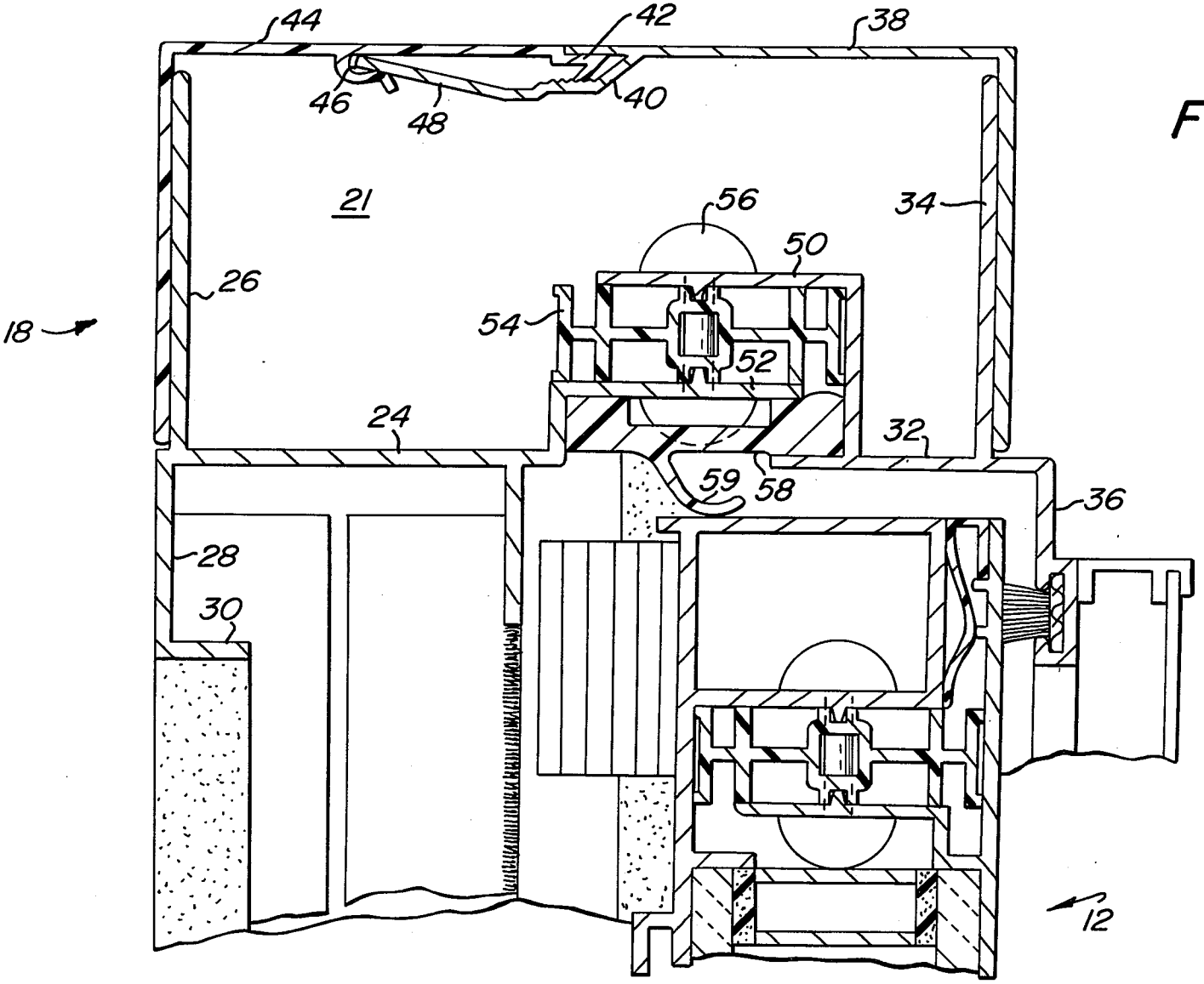
FIG. 2 is a sectional view taken along the line 2—2 in FIG. 1 but on an enlarged scale.

Referring to FIG. 2, it will be noted that the top member 18 is hollow so as to include a chamber 21. In FIG. 2, the indoor face of the frame is at the left side of the figure. The top member 18 includes a rail member 24 having flanges 26 and 28 extending in opposite directions. Flange 26 is longer than flange 28. Flange 28 terminates in an outwardly directed flange 30. Rail member 24 is made of metal such as aluminum.

Adjacent the outdoor face, the top member 18 includes a rail member 32 having flanges 34 and 36 extending in opposite directions. Flange 34 is coextensive with flange 26. The flanges 26 and 34 are interconnected by a casing. The casing includes casing portion 38 of metal which has one leg juxtaposed of flange 34 and a leg extending inwardly. The inwardly extending leg of casing portion 38 has a jaw 40 and a tongue 48. The casing portion 44 is non-metallic and preferably of a polymeric plastic material having one leg juxtaposed to flange 26 and an outwardly extending leg. The outwardly extending leg has a jaw 46 which receives tongue 48 and has a tongue 42 snapped into the jaws 40.

The rail member 24 has a wall 52 parallel to and spaced from a wall 50 on rail member 32. A non-metallic thermal barrier strip 54 is juxtaposed to the walls 50 and 52 and contacts the same at spaced paralled zones. Strip 54 is preferably a polymeric plastic. Non-metallic rivets, 56 of a material such as a polymeric plastic, are provided at spaced points along the walls 50 and 52 for joining the walls to each other with the barrier strip 54 therebetween. A head seal 58 of plastic material such as foam rubber has a flexible lip 59 biased into contact with sash 12. Seal 58 is mounted in the space between rail members 24 and 32.

As will be seen in FIG. 2, all metal portions on the outdoor face are thermally insulated from metal portions on the indoor face by way of the barrier strip 54. Further, the casing is made partially from metal and partially from plastic with the portions being coupled together without the use of fasteners while providing a thermal break between the indoor and outdoor faces of the top member 18 of the frame 10.

Figure 3:
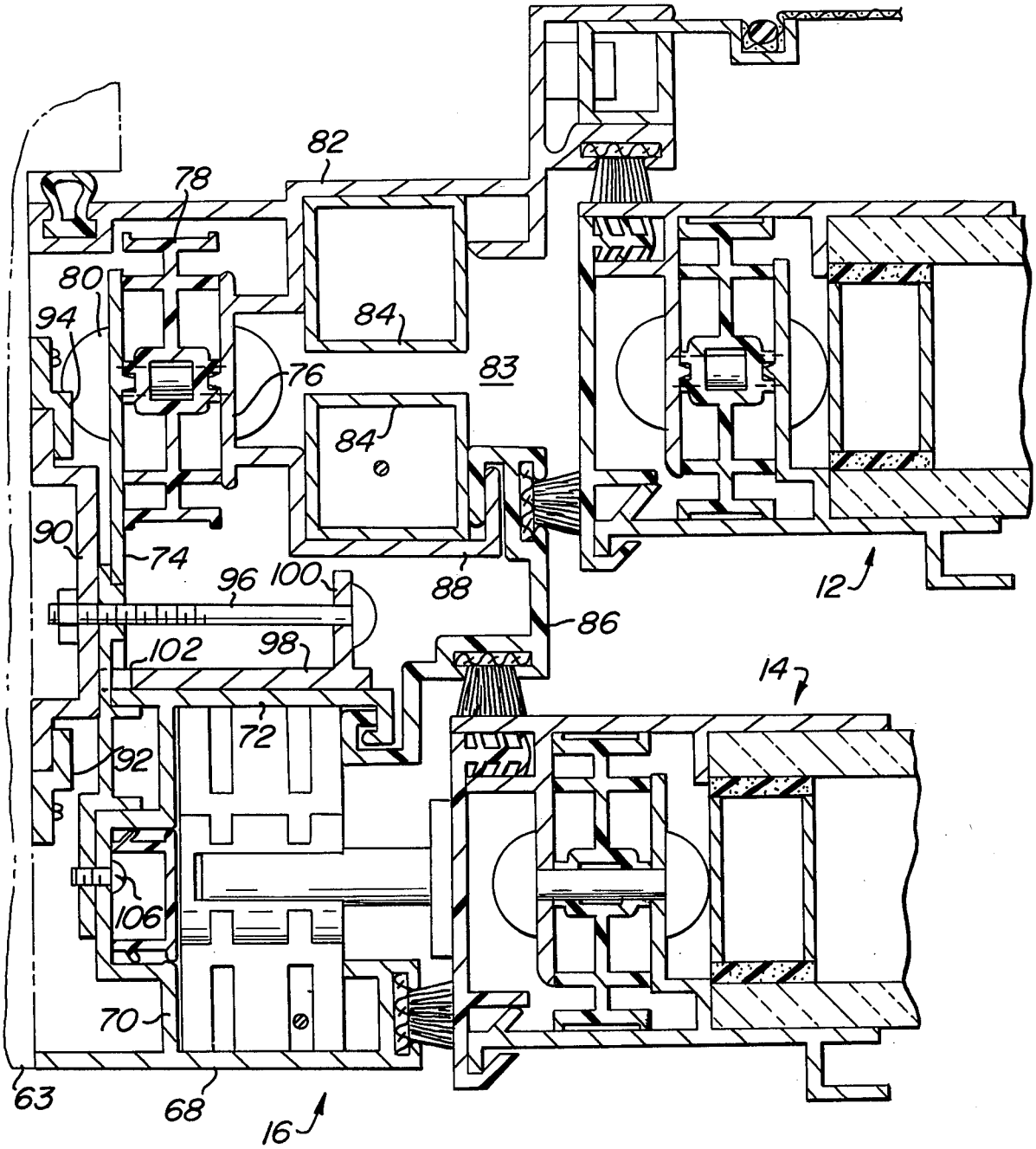
FIG. 3 is a sectional view taken along the line 3—3 in FIG. 1 but on an enlarged scale.

In FIG. 3, there is illustrated a cross-section of the side member 16. The indoor face of the frame is at the bottom of the figure. A wall 63 is provided with an opening which receives the frame 10. The side member 16 on the indoor face thereof includes rail member 68 having an outwardly directed portion 70 and a transverse portion 72. An outwardly directed wall 74 is integral with and extends from the transverse portion 72. A wall 76 is juxtaposed to wall 74 and thermally insulated therefrom by the thermal barrier strip 78. Plastic rivets 80 join the walls 74 and 76 together with the strip 78 therebetween. Strip 78 contacts the walls 74 and 76 with spaced parallel zones of contact.

The wall 76 is integral with a rail member 82 on the outdoor face of the frame 10. A rail member 82 is provided with a channel 83 which receives counterbalances 84 for the upper sash 12. A plastic bridge 86 extends between the end portion 88 of rail member 82 and the transverse portion 72. The bridge 86 is provided with recesses in which are mounted flexible strips of material such as felt for contact with juxtaposed portions of the sashes 12 and 14.

A bracket 90 is secured in the recess of the wall 63 by way of keepers 92, 94 which in turn may be fastened to the wall 63. Bracket 90 has a projection 98 terminating in an outwardly directed flange 100. A bolt 96 extends through a hole in the flange 100 and is threaded to a tapped hole in metal member 102. Bolt 96 also extends through a hole in the bracket 90 and receives a nut on a threaded end portion thereof.

The metal member 102 extends through a slot in the projection 98. The metal member 102 has a boss extending through a hole in the wall 74 and is fixedly secured to the portion 70 by way of fastener 106. In connection with FIG. 3, it will be noted that there is a complete thermal break between any of the metal members on the outdoor face as compared with the metal members on the indoor face due to the presence of the barrier strips 78 and the bridge 86.

Figure 4:
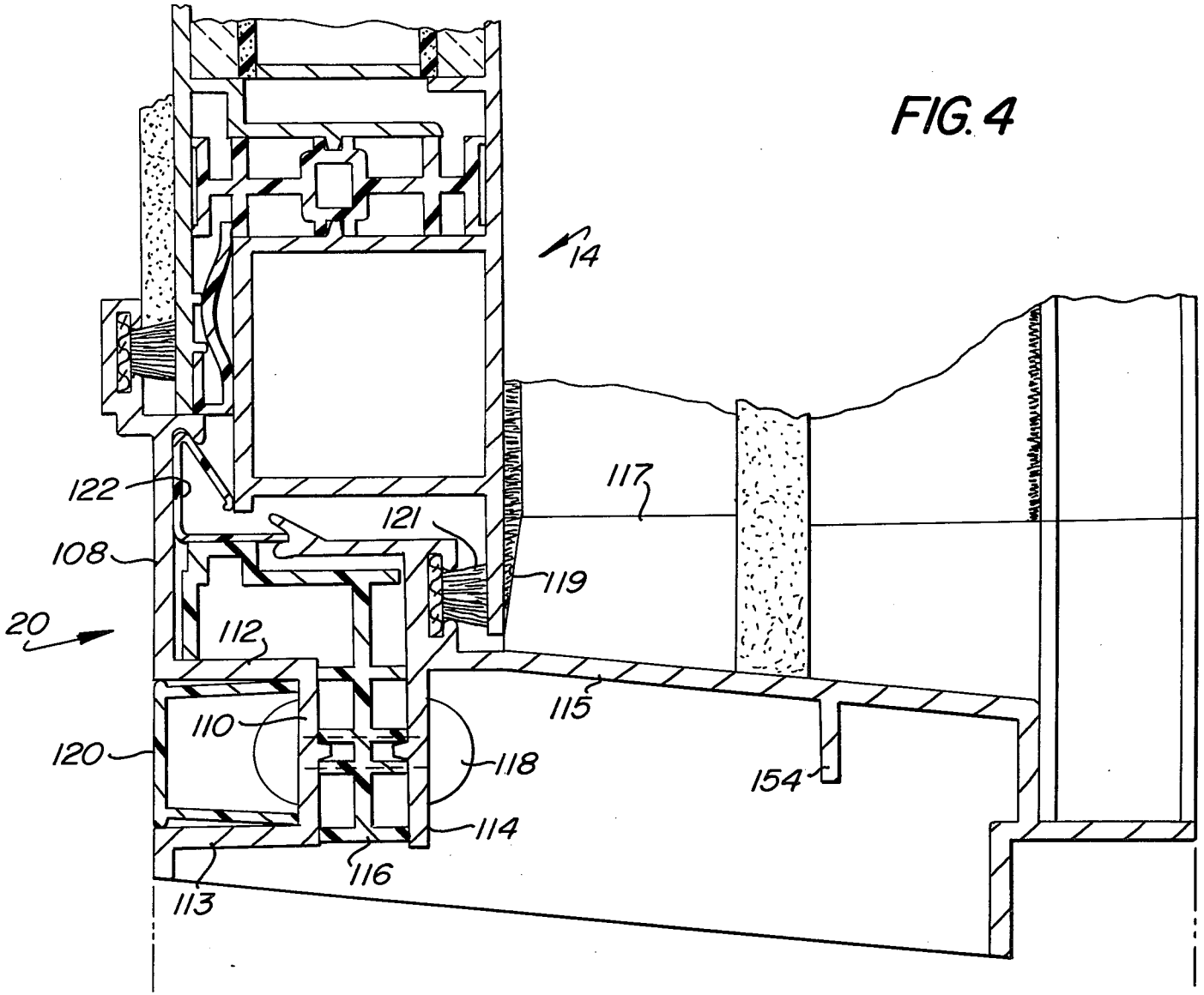
FIG. 4 is a sectional view taken along the line 4—4 in FIG. 1 but on an enlarged scale.

The sill member 20 is shown in detail in FIG. 4. As illustrated in FIG. 4, the sill member 20 includes a rail member 108 on the indoor face thereof. Rail member 108 has a wall 110 thereof parallel to the indoor face and extending between the walls 112, 113 which cooperate therewith to form a cavity on the indoor face.

The wall 110 is juxtaposed to a wall 114 on rail member 115. Rail member 115 is on the outdoor face of the sill member 20. Walls 110 and 114 are secured together by rivets 118 at spaced points therealong with the barrier strip 116 disposed therebetween. The thermal barrier strip 116 contacts the walls 110, 114 at spaced parallel zones.

A removable plastic cover 120 is inserted into the recess defined by the walls 110, 112 and 113 to obscure the heads of the rivets 118. A plastic keeper strip 122 extends between the rail member 108, the sash 14, and an end portion of the rail member 115. It will be noted that all metal members on the indoor face in FIG. 4 are insulated by a polymeric plastic strip from cooperating metal members on the outdoor face of the frame 10. Rail member 115 supports a sash guide 117 adjacent each end thereof. The sash guides 117 have an angled face 119 for caming the sash 114 in its lowermost position toward the pile seal 121 on sill member 20.

The side members 16 and 17 are connected together at their upper end with the top member 18 by way of corner members 128 and 130. The corner members 128 and 130 are made of a polymeric plastic and are identical except for being righthand and lefthand. The lower end of the side members 16 and 17 are interconnected with the sill membr 20 by way of corner members 124 and 126. The corner members 124 and 126 are made of polymeric plastic and are identical except for righthand and lefthand. Accordingly, only corner members 128 and 124 will be described in detail herein.

Figure 5:
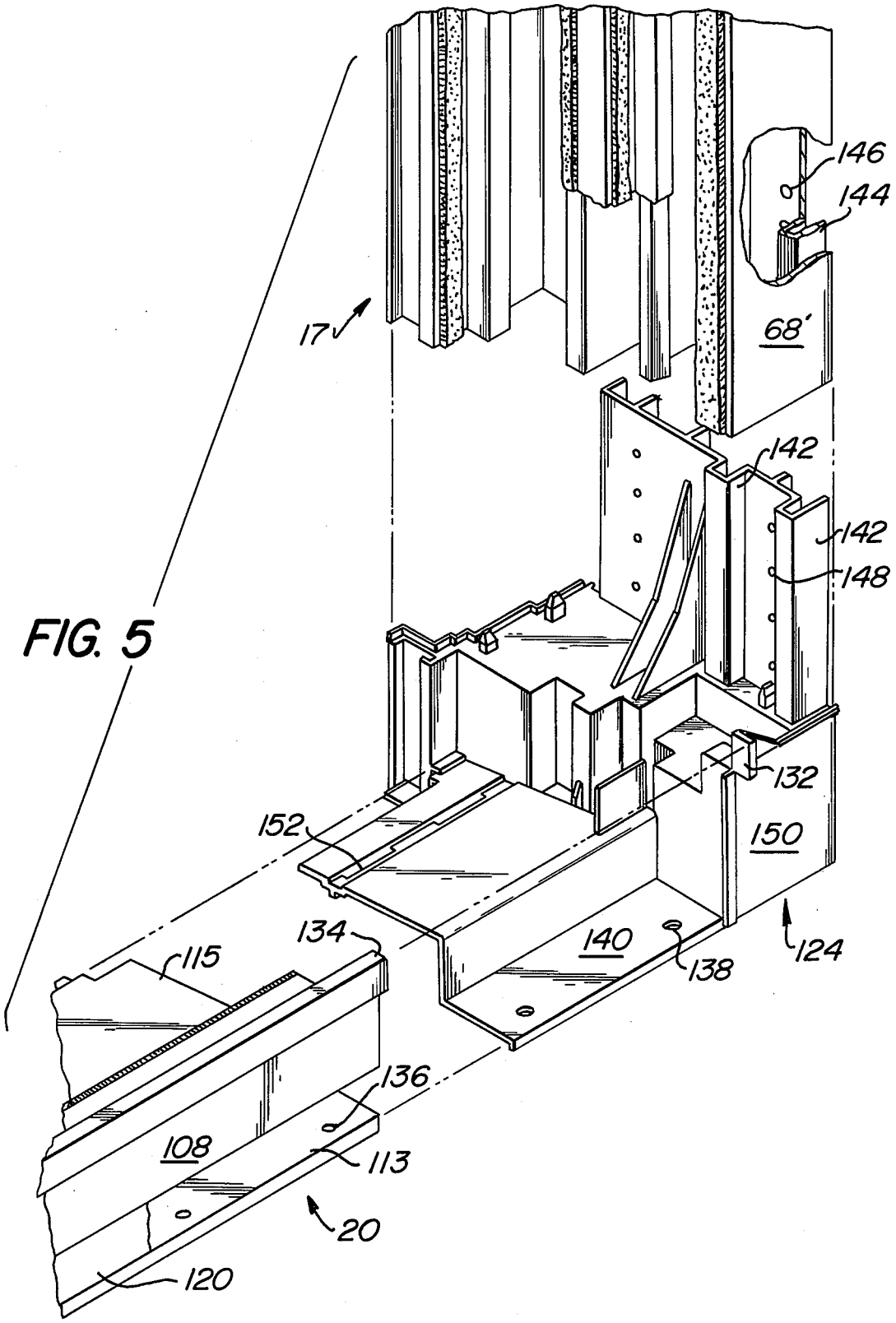
FIG. 5 is an exploded partial perspective view of the lower right corner of the frame but on an enlarged scale.

Referring to FIG. 5, there is illustrated a partial exploded perspective view of the corner member 124 and the manner in which it is to be removbly coupled to the members 17 and 20. In FIG. 5, the elements are illustrated from the inside face of the frame 10. The corner member 124 is molded from a polymeric plastic in one piece as shown more clearly in FIGS. 5 and 6.

As shown in FIG. 5, the corner member 124 includes a limit stop 132 adapted to be engaged by end portion 134 on the rail member 108. When the end portion 134 contacts the limit stop 132, holes 136 on the wall 113 are aligned with holes 138 on the projection 140 from the body of corner member 124. Fasteners not shown are utilized to interconnect projection 140 with wall 113.

Corner member 124 has upstanding channels 142 which telescope into channels 144 on the rear face of the side member 17. When the channels 142 are so orientated, holes 146 on a wall of the side member 17 will become aligned with holes 148 arranged in a row between adjacent channels 142. Fasteners not shown are utilized to interconnect the aligned holes to couple side member 17 to the corner member 124.

When the corner member 124 is connected to the sill member 20 and side member 17, a side face 150 on the body of the corner member 124 lies in the same plane as the rail member 68' on side member 17 and in the same plane with the rail member 108 on the sill member 20. A further coupling of the sill member 20 to the corner member 124 may be attained by way of projections 154 on rail member 115 which become aligned with and extend through the slots 152 on the projection 140. As will be apparent from the illustrations, the distance between the indoor and outdoor faces of the corner member 124 correspond to the distance between the indoor and outdoor faces on the side members 16, 17 and sill member 20 of the frame 10.

Figure 7:
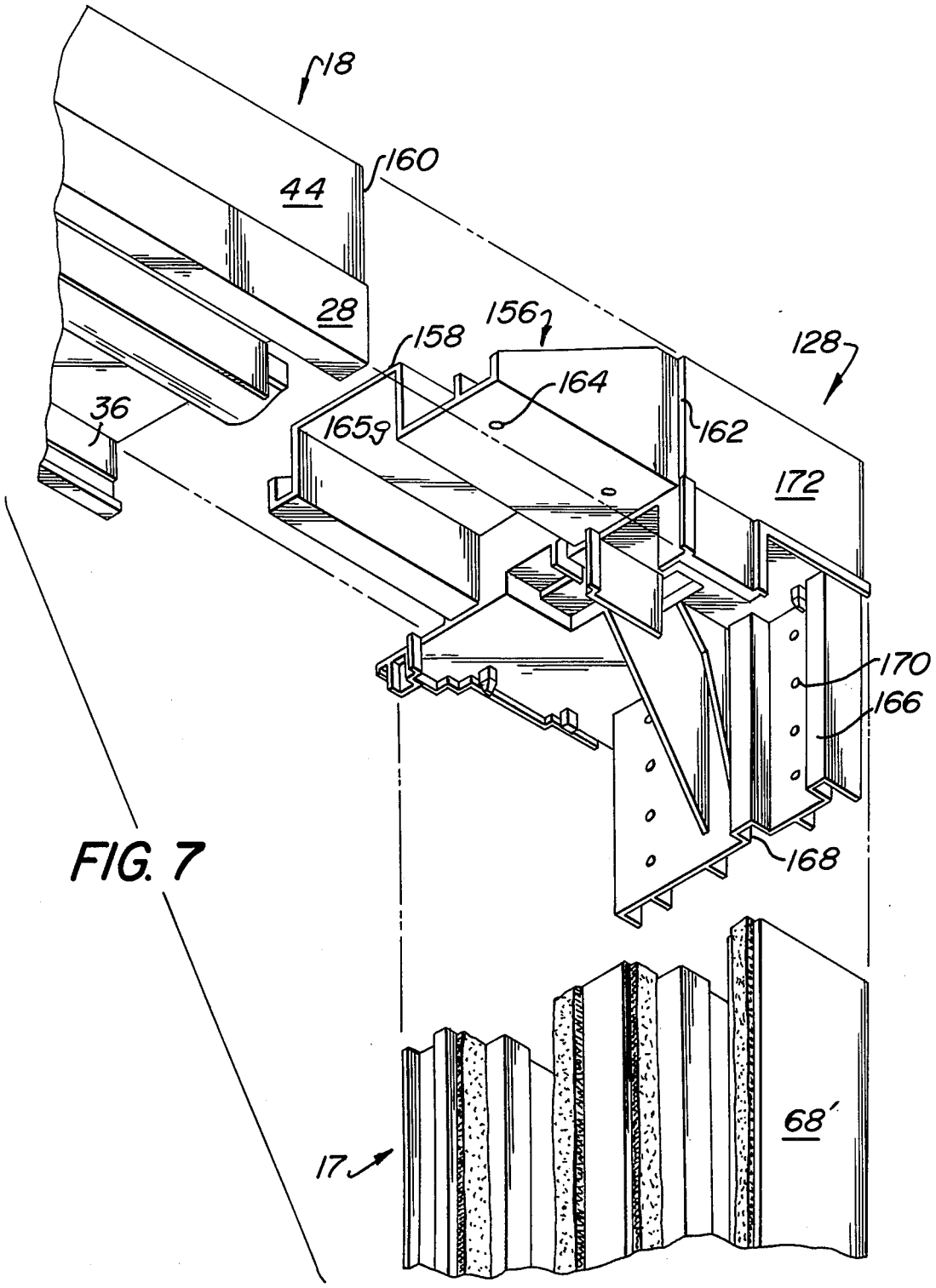
FIG. 7 is a partial exploded perspective view of the upper right corner of the frame in FIG. 1 but on an enlarged scale.

Referring to FIGS. 7 and 8, the corner member 128 is provided with a projection 156 which is slightly narrower than the distance across the indoor and outdoor faces of the corners member 128 so that projection 156 may telescope into the chamber 21 in the top member 18. The projection 156 is provided with a channel 158 between flat portions adapted to overlie the rail members 24 and 32. The channel 158 extends around the thermal barrier strip 54 and the rivits 56 in FIG. 2.

The projection 156 is provided with holes 164 adapted to mate with holes (not shown) in rail member 24. The channel 158 is provided with holes 165 adapted to mate with holes (not shown) in the casing portion 38. The holes on the projection 156 line up with mating holes on the top member 18 when end portion 160 abuts against limit stop 162 on the corner member 128. The side face 172 of the corner member 128 is then flush with the indoor face of the top member 18.

The corner member 128 includes channels 166 and 168 adapted to telescope into mating channels at the upper end of the side member 17. A plurality of holes 170 are provided on the corner member 128 for alignment with mating holes on the side member 17.

Each of the polymeric plastic described above may be any one of a wide variety of polymeric plastic with are commercially available. The thermal barrier strips are preferably made from a rigid strong polymeric plastic such as polyvinylchloride which can be extruded, will hold tolerances, is a poor heat conductor and will not absorb more than about 5% water. Since the thermal barrier strips are not exposed to sunlight, they need not be UV resistant. The thermal coefficient of conductivity of the barrier strips is less than about 0.2. Each corner member is preferably made from a strong rigid polymeric plastic such as nylon 6-6 and is UV resistant. Nylon 6-6 can be molded, with hold tolerances, and will not change its characteristics over a wide range of temperatures.

The corner members form an integral part of providing a complete thermal break between metal members on the indoor face and metal members on the outdoor face of the frame. At the same time, the corner members constitute the means for structurally interconnecting the side members 16, 17 with the top member 18 and the sill member 20. It will be noted that each corner member has a projection telescope into or overlaps a top member 18 or a sill member 20 and a projection that telescopes into one of the side members 16, 17. While metal members on the indoor face and outdoor face of the frame 10 are thermally insulated from one another, there are structurally connected together by way of non-metallic fasteners which also extend through the thermal barrier strip associated therewith.

The present invention may be embodied in other specific forms without departing from the spirit or essential attributes thereof and, accordingly, reference should be made to the appended claims, rather than to the foregoing specification as indicating the scope of the invention.

It is claimed:

1. A window frame adapted to receive at least one sash comprising a rectangular frame having an outdoor face and an indoor face, said frame having side members connected to a top member and a sill member, four corner members of non-metallic material whose width corresponds to the general width of said faces on said frame, each frame member being connected to an adjacent frame member by one of said corner members, each frame member having a metal component on the outdoor face thermally insulated from a metal component on the indoor face by a non-metallic thermal barrier strip, each barrier strip having spaced parallel zones of contact with juxtaposed walls of said metal components associated therewith, and non-metallic fasteners structurally connecting said juxtaposed walls and the thermal barrier strip associated therewith.

2. A window frame in accordance with claim 1 wherein each corner member has a projection telescoped into and fastened to one of the side members, each corner member having a projection fastened to a juxtaposed portion of one of the top member and sill member.

3. A window frame in accordance with claim 1 wherein the metal components on the indoor and outdoor faces of the frame side members are thermally isolated from one another by said barrier strip and at least one other non-metallic strip spaced from the barrier strip.

4. A window frame in accordance with claim 1 wherein said frame top member is hollow and defined by spaced rail members having mating portions coupled together by a casing, said casing being at least in part made from a non-metallic material.

5. A window frame in accordance with claim 1 wherein each corner member is a one piece plastic member.

6. A window frame in accordance with claim 1 including a bracket connected to each side member for securing said frame in an opening in a wall.

7. A window frame in accordance with claim 1 including a non-metallic support for at least one flexible sash engaging insulating material, said support extending between one metal component on the indoor face and one metal component on the outdoor face.

8. A window frame adapted to receive at least one sash comprising a rectangular frame having an outdoor face and an indoor face, said frame having side members connected to a top member and a sill member, four corner members each being a one-piece non-metallic material whose width corresponds to the general width of said faces on said frame, each corner member having a projection overlying a portion of and fastened to one of the side members, each corner member having a projection fastened to a juxtaposed portion of one of the top members and sill member, each frame member having a metal component on the outdoor face thermally insulated from a metal component on the indoor face by a non-metallic thermal barrier strip, each barrier strip having spaced parallel zones of contact with juxtaposed walls of said metal components associated therewith, said juxtaposed walls having a thickness substantially less than the distance between them, non-metallic fasteners structurally connecting said juxtaposed walls and the thermal barrier strip associated therewith, and means on at least two of said members for securing the frame in an opening.

* * * * *